US009664041B2

(12) United States Patent
Jones et al.

(10) Patent No.: US 9,664,041 B2
(45) Date of Patent: May 30, 2017

(54) DRILL RIG

(71) Applicant: Caterpillar Global Mining Expanded Products Pty Ltd., Tullamarine (AU)

(72) Inventors: Steven P. Jones, Charlestown (AU); William A. Furniss, Saratoga (AU); Andrew D. Tolmie, Wallsend (AU)

(73) Assignee: Caterpillar Global Mining Expanded Products Pty Ltd, New South Wales (AU)

( * ) Notice: Subject to any disclaimer, the term of this patent is extended or adjusted under 35 U.S.C. 154(b) by 385 days.

(21) Appl. No.: 14/104,255

(22) Filed: Dec. 12, 2013

(65) Prior Publication Data

US 2015/0167463 A1 Jun. 18, 2015

(51) Int. Cl.

| | |
|---|---|
| ***E21D 20/00*** | (2006.01) |
| ***E21B 11/00*** | (2006.01) |
| ***E21B 19/086*** | (2006.01) |
| ***E21B 7/02*** | (2006.01) |
| ***E21B 15/00*** | (2006.01) |

(52) U.S. Cl.

CPC ..... *E21D 20/003* (2013.01); *E21B 7/023* (2013.01); *E21B 11/00* (2013.01); *E21B 15/00* (2013.01); *E21B 19/086* (2013.01)

(58) Field of Classification Search

CPC ..... E21B 19/06; E21B 19/08; E21B 11/00; E21B 19/086; E21B 44/02; E21B 7/023; E21B 15/00; E21D 20/003

See application file for complete search history.

(56) References Cited

U.S. PATENT DOCUMENTS

| | | | | |
|---|---|---|---|---|
| 4,856,384 | A | 8/1989 | Wechner | |
| 6,105,684 | A * | 8/2000 | Pointer | E21B 19/084 173/141 |
| 6,302,623 | B1 * | 10/2001 | Nellson | E21D 20/003 211/70 |
| 6,360,675 | B1 * | 3/2002 | Jones | A47B 21/06 108/50.02 |
| 6,796,388 | B2 * | 9/2004 | O'Meley | E21D 20/003 173/11 |
| 6,814,155 | B1 * | 11/2004 | Nielson | E21D 20/003 173/11 |
| 7,067,866 | B2 * | 6/2006 | Shi | H01L 27/228 257/296 |
| 7,607,866 | B2 | 10/2009 | Eddowes et al. | |
| 2004/0118578 | A1 | 6/2004 | O'Meley | |
| 2010/0003120 | A1 | 1/2010 | Eddowes et al. | |
| 2010/0266346 | A1 * | 10/2010 | Eddowes | B65H 51/10 405/259.1 |

* cited by examiner

*Primary Examiner* — Yong-Suk Philip Ro

(57) ABSTRACT

A drill rig includes a frame and a pair of cylinder rods provided laterally spaced relative to each other. The pair of cylinder rods is configured to extend and retract relative to the frame along an axial direction. The drill rig includes a carriage unit mounted to the frame. The carriage unit includes a pair of slide blocks laterally spaced relative to each other. Each of the pair of slide blocks includes an axial channel therein. The carriage unit includes a support member provided slidably within each of the axial channels. The carriage unit includes a center member coupled to and provided between the support members. The center member is configured to reinforce the support member. The carriage unit includes a slide rail longitudinally spaced relative to the support member. The drill rig includes a drilling unit slidably mounted on the slide rail.

17 Claims, 9 Drawing Sheets

DRILL RIG

TECHNICAL FIELD

The present disclosure relates to a drill rig, and more specifically to a drill rig for strata control bolting.

BACKGROUND

Currently used drill rigs for drilling bores and/or installing bolts in a mine or a tunnel surface are powered by hydraulic and/or pneumatic systems. Such a drill rig may require one or more hoses and/or tubes to provide a flow of fluid for powering various components of the drill rig. The hoses may tend to increase an overall weight, design complexity and cost of the drill rig. Further, the drill rig may be provided with one or more structural members to provide support to the drill rig. During operation of the drill rig, forces and bending moments may act on the structural member in various directions. This may result in extreme stress and strain on the structural member causing the structural member to undergo detrimental deformations.

U.S. Pat. No. 6,105,684 discloses improvements in the operation and construction of roof bolters or roof bolt installation apparatus. The improvements include a roof bolter constructed so that the critical moving parts of its timber jack, feed frame, feed carrier and rotational unit are comprised of a rod and sleeve construction. Such construction allows the protection of surfaces. The construction also includes feature of a spaced apart rod and sleeve construction which allows motive power units to be housed within the confines of the timber jack and feed carrier. The spaced apart arrangement also provides stability to the roof bolter.

U.S. Pat. No. 7,607,866 discloses a bolting apparatus and method for inserting a rod into a surface. The bolting apparatus includes a base having a foot end and a head end. The bolting apparatus includes at least one stabilizing rod extendable from the base head end and having a stabilizing rod end adapted to contact a surface to be drilled. The bolting apparatus includes a mechanism attached to the base between the base foot end and the stabilizing rod end and adapted to grip the rod.

SUMMARY OF THE DISCLOSURE

In one aspect of the present disclosure, a drill rig is provided. The drill rig includes a frame. The drill rig includes a pair of cylinder rods provided laterally spaced relative to each other. The pair of cylinder rods is configured to extend and retract relative to the frame along an axial direction. The drill rig also includes a carriage unit mounted to the frame. The carriage unit includes a pair of slide blocks provided laterally spaced relative to each other. Each of the pair of slide blocks includes an axial channel provided therein. The carriage unit includes a support member provided slidably within each of the axial channels. The carriage unit also includes a center member coupled to and provided between the support members. The center member is configured to reinforce the support member. The carriage unit further includes a slide rail provided longitudinally spaced relative to the support member. The drill rig further includes a drilling unit slidably mounted on the slide rail.

In another aspect of the present disclosure, a carriage unit for a drill rig is provided. The carriage unit includes a pair of slide blocks provided laterally spaced relative to each other. Each of the pair of slide blocks includes an axial channel provided therein. The carriage unit also includes a support member provided slidably within each of the axial channels. The carriage unit further includes a center member coupled to and provided between the support members. The center member is configured to reinforce the support member.

In yet another aspect of the present disclosure, a drill rig is provided. The drill rig includes a frame. The drill rig includes a pair of cylinder rods provided laterally spaced relative to each other. The pair of cylinder rods is configured to extend and retract relative to the frame along an axial direction. The drill rig also includes a carriage unit mounted to the frame. The carriage unit includes a pair of slide blocks provided laterally spaced relative to each other. Each of the pair of slide blocks includes an axial channel provided therein. The carriage unit includes a support member provided slidably within each of the axial channels. The support member includes a slot. The carriage unit also includes a center member received within the slots. The center member is coupled to the support member using a mechanical fastener. The center member is configured to reinforce the support member. The carriage unit further includes a slide rail provided longitudinally spaced relative to the support member. The drill rig further includes a drilling unit slidably mounted on the slide rail.

Other features and aspects of this disclosure will be apparent from the following description and the accompanying drawings.

DETAILED DESCRIPTION

Figure 1:
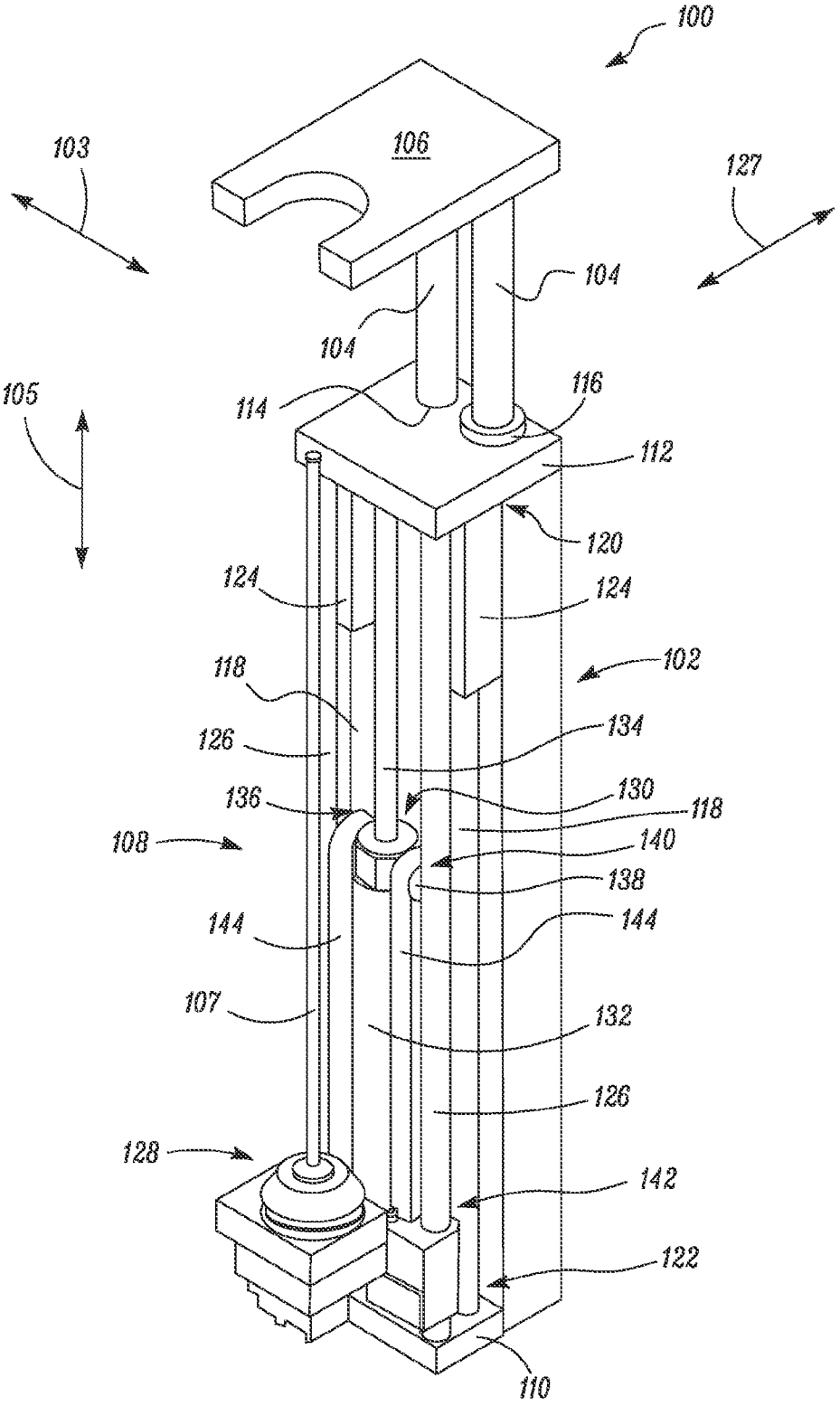
FIG. 1 is a perspective view of a drill rig, according to one embodiment of the present disclosure.

Wherever possible, the same reference numbers will be used throughout the drawings to refer to the same or the like parts. Referring to FIG. 1, a perspective view of a drill rig 100 is illustrated. The drill rig 100 may be configured to drill bores and/or install rock bolts, anchor bolts and so on into a roof, a floor and/or a rib of a mine. It should be noted by one of ordinarily skilled in the art that the drill rig 100 may be configured for strata control bolting and may include applications such as a tunnel, roadway and so on. The drill rig 100 may be a standalone equipment or may be installed on a machine including, but not limited to, a roof bolting machine, a longwall mining machine, a tunneling machine and a continuous mining machine. It should be noted by one skilled in the art, that the drill rig 100, in addition to mining, may have applications in a number of industries, such as construction.

As shown in FIG. 1, the drill rig 100 includes a frame 102. It may be apparent to a person ordinarily skilled in the art that the frame 102 houses a timber jack. The frame 102 includes methods to mount the drill rig 100 to equipment. The frame 102 includes a pair of cylinder rods 104 provided slidably within the frame 102. Accordingly, as shown in FIG. 2, the frame 102 includes a pair of cylinders 202 to slidably receive the pair of cylinder rods 104 which will be explained later in detail.

Referring to FIG. 1, each of the pair of cylinder rods 104 is provided spaced along the lateral direction 103 relative to each other. The pair of cylinder rods 104 is configured to extend and retract relative to the frame 102 along an axial direction 105. The pair of cylinder rods 104 may be powered by a hydraulic arrangement, a pneumatic arrangement, an electromechanical drive or a combination thereof. In one embodiment, the power may be provided to each of the pair of cylinder rods 104 separately or simultaneously. In another embodiment, the power may be provided to any one of the pair of cylinder rods 104. In such a situation, the other cylinder of the pair of cylinder rods 104 may act as a dummy cylinder in order to provide a guide, stability and/or alignment to a head plate 106 which will be explained later. As shown in FIG. 1, each of the pair of cylinder rods 104 has a circular cross section. In other embodiments, each of the pair of cylinder rods 104 may have any other cross sectional configuration such as, a polygonal cross section, an elliptic cross section, and so on.

Figure 2:
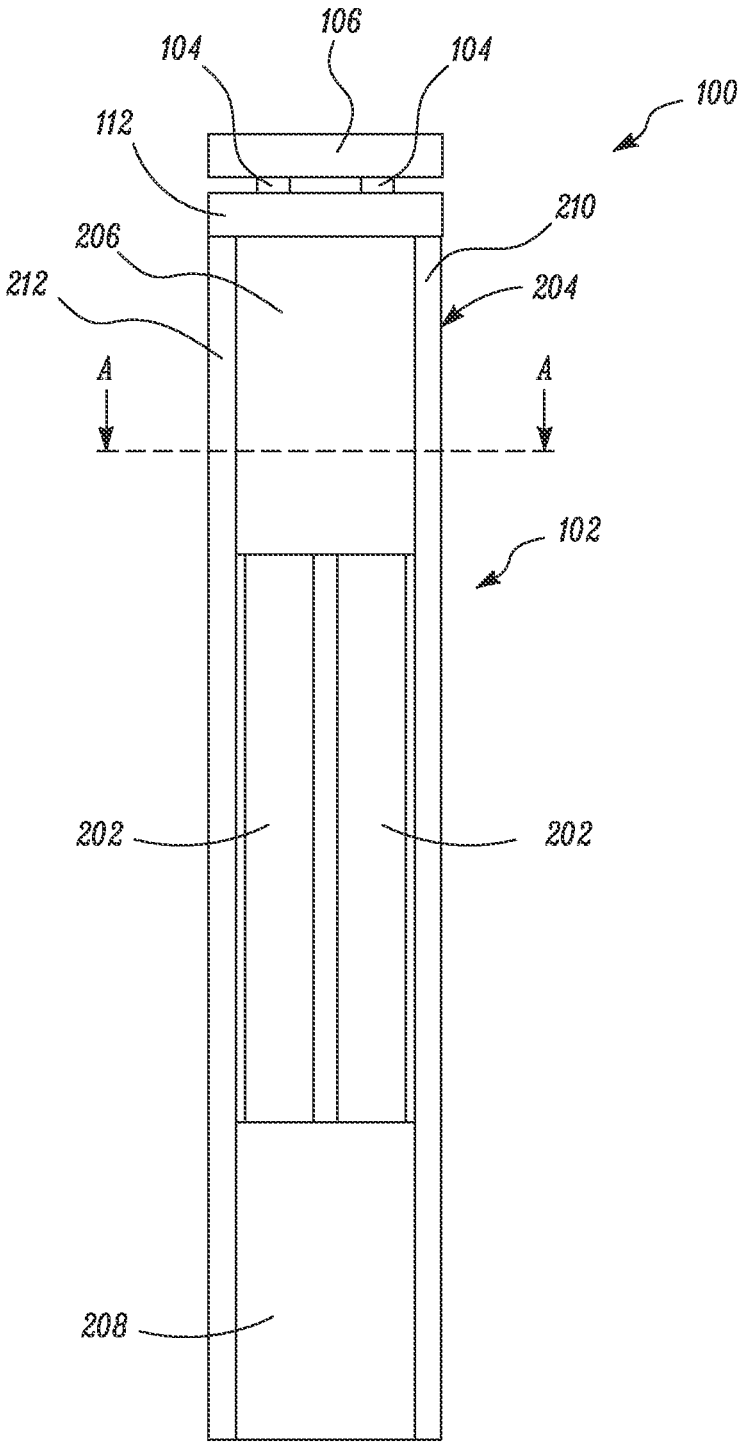
FIG. 2 is a rear view of the drill rig, according to the embodiment of FIG. 1.

FIG. 2 illustrates a rear view of the drill rig 100, according to the embodiment of FIG. 1. The drill rig 100 includes a main manifold 204, a first manifold 206 and a second manifold 208 provided on the frame 102. The main manifold 204 includes a first section 210 and a second section 212. The first and second sections 210, 212 are spaced along the lateral direction 103 relative to each other. The first and second manifolds 206, 208 are provided between the first and second sections 210, 212 of the main manifold 204, and spaced along the axial direction 105 relative to each other. The first and second manifolds 206, 208 are fluidly coupled to the first and second sections 210, 212 of the main manifold 204. The first and second manifolds 206, 208 are configured to slidably receive the pair of cylinder rods 104. The main manifold 204 is configured to provide fluid to the first and second manifolds 206, 208 for powering the pair of cylinder rods 104. Further, the main, first and second manifolds 204, 206, 208 may include one or more passages, seals, bearings and/or valves (not shown) configured to provide a path and/or control of flow of fluid between the main, first and second manifolds 204, 206, 208.

The drill rig 100 includes the pair of cylinders 202 extending between the first and second manifolds 206, 208. Each of the pair of cylinders 202 is configured to slidably receive one of the pair of cylinder rods 104. A configuration of the pair of cylinders 202 corresponds to the configuration of the pair of cylinder rods 104. More specifically, the configurations may correspond such that outer surfaces of the pair of cylinder rods 104 may conform to the inner surfaces of the pair of cylinders 202. The cylinders 202 may be formed as a single integral component to slidably receive the pair of cylinder rods 104 together. In another embodiment, each of the pair of cylinders 202 may be formed of two or more separate sections configured to independently and slidably receive each of the pair of cylinder rods 104. In yet another embodiment, the cylinders 202 may be an integral part of the first manifold 206, the second manifold 208 and/or the main manifold 204. Further, the pair of cylinders 202 may be fluidly coupled to the first and second manifolds 206, 208 and/or the main manifold 204 for transmission of the fluid therebetween required for powering the pair of cylinder rods 104.

Referring to FIG. 1, the pair of cylinder rods 104 includes the head plate 106 coupled to a top surface of the pair of cylinder rods 104. The head plate 106 is configured to move along the axial direction 105 based on the extension and retraction of the pair of cylinder rods 104. Accordingly, the head plate 106 may be positioned in a raised position or a lowered position, respectively. During operation of the drill rig 100, the frame 102 including the main, first and second manifolds 204, 206, 208, and the cylinders 202 remain stationary whereas the head plate 106 is configured to rest against the roof or the rib of the mine. Accordingly, the head plate 106 may provide support to a drill rod 107 and/or a rock bolt (not shown) during the drilling and the bolting operation, respectively.

In an embodiment, the head plate 106 may include one or more grasping members (not shown) such as jaws, clasps, fingers and so on operated by hydraulic, pneumatic or hydraulic means. The grasping members may be configured to grip the drill rod 107 and/or the rock bolt during operation of the drill rig 100. In such an embodiment, each or any one of the pair of cylinder rods 104 may include an internal bore (not shown) provided axially within the respective cylinder rod 104. The internal bore may provide fluid communication between the grasping members and the main, first and/or second manifolds 204, 206, 208 for supplying fluid and powering the grasping members.

The drill rig 100 includes a carriage unit 108 mounted to the frame 102. The carriage unit 108 includes an end plate 110. The end plate 110 is configured to provide a base for the carriage unit 108. The carriage unit 108 further includes a guide plate 112. The guide plate 112 is spaced along the axial direction 105 relative to the end plate 110. The guide plate 112 includes a pair of bores 114. Each of the pair of bores 114 is configured to slidably receive each of the pair of cylinder rods 104. Accordingly, the guide plate 112 is configured to translate along the axial direction 105 along the pair of cylinder rods 104.

The guide plate 112 includes a bush 116 provided over any one or each of the pair of bores 114. More specifically, the bush 116 has a hollow configuration having an inner diameter corresponding to an outer diameter of the respective cylinder rod 104. Accordingly, the bush 116 may be independent to slide over the respective cylinder rod 104. The bush 116 may be fixedly attached to the guide plate 112 or may independently slide over the cylinder rod 104 relative to the guide plate 112. The bush 116 is configured to introduce a clearance, and prevent surface contact between the guide plate 112 and the head plate 106 during operation of the drill rig 100.

Figure 4:
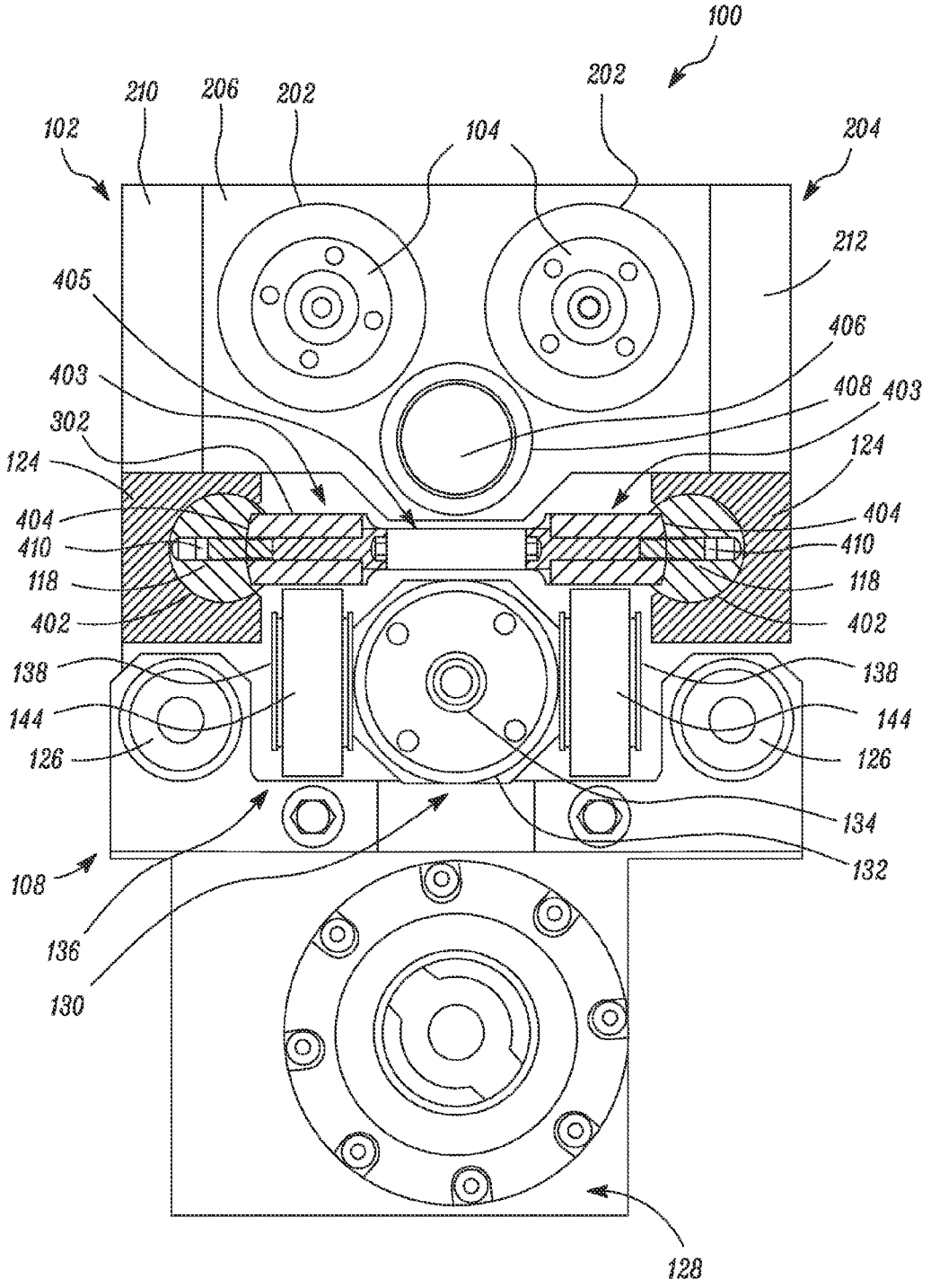
FIG. 4 is a sectional top view of the drill rig along an axis A-A, according to an embodiment of the present disclosure.

The carriage unit 108 includes a pair of support members 118 extending between the end plate 110 and the guide plate 112. Each of the pair of support members 118 is provided on the carriage unit 108 and extends along the axial direction 105. Each of the pair of support members 118 is spaced along the lateral direction 103 relative to each other. The pair of support members 118 is provided such that the guide plate 112 is coupled to a first end 120 of the pair of support members 118 and the end plate 110 is coupled to a second end 122 of the pair of support members 118. Each of the pair of support members 118 is configured to support the carriage unit 108. As shown in FIG. 4, each of the pair of support members 118 has a substantially D-shaped cross section. In another embodiment, each of the pair of support members 118 may have any other configuration, such as a polygonal cross section, an elliptical, and so on. In yet another embodiment, a wear resistant coating may be provided on each of the pair of support members 118.

The carriage unit 108 includes a pair of slide blocks 124. Each of the pair of slide blocks 124 is provided on the frame 102 and extend along the axial direction 105. Each of the pair of slide blocks 124 is spaced along the lateral direction 103 relative to each other. More specifically, the pair of slide blocks 124 may be fixedly coupled to the first and second sections 210, 212 of the main manifold 204. As shown in FIG. 4, each of the pair of slide blocks 124 includes an axial channel 402 provided therein. The axial channel 402 is configured to slidably receive the support member 118. Each of the pair of slide blocks 124 includes each of the pair of support members 118 provided within the respective axial channel 402.

Figure 3:
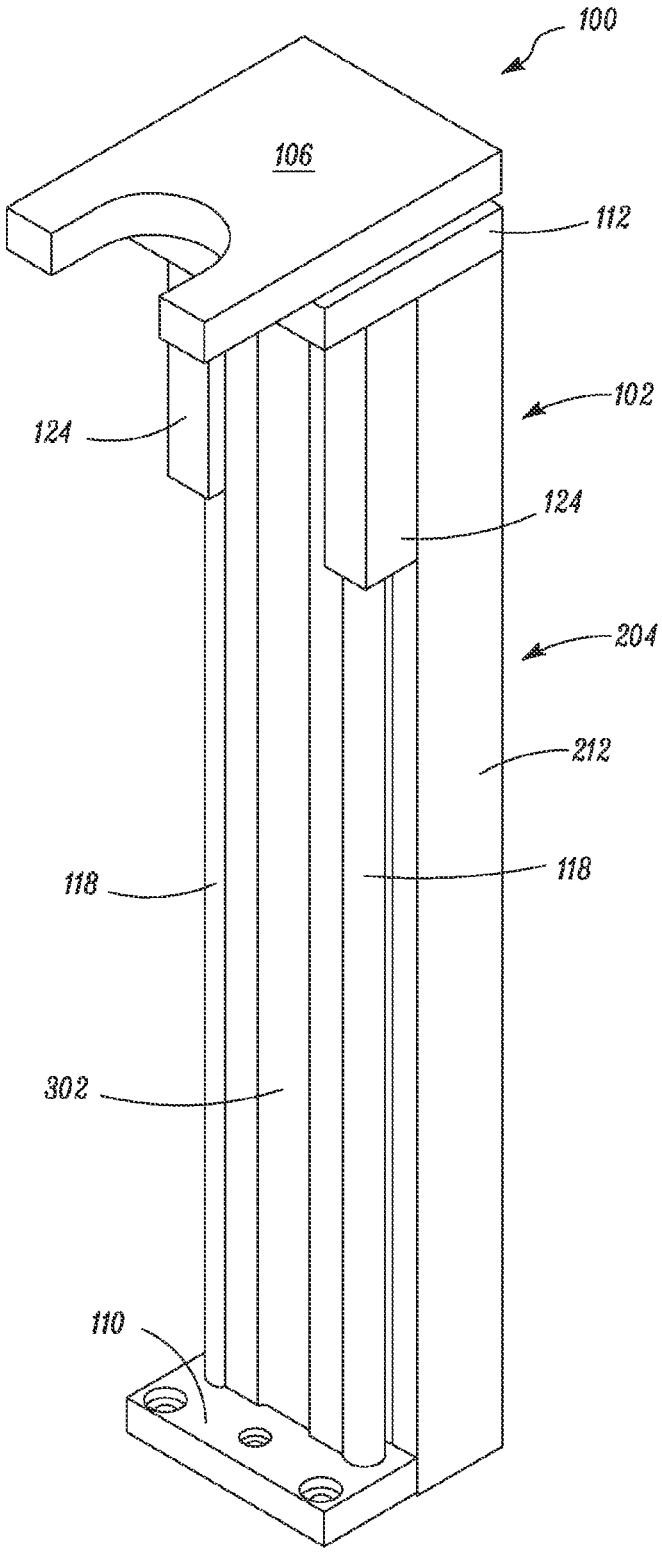
FIG. 3 is a partial perspective view of the drill rig showing a support member and a center member, according to an embodiment of the present disclosure.

FIG. 3 illustrates a perspective view of the drill rig 100 showing a portion of the carriage unit 108, according to an embodiment of the present disclosure. The present disclosure relates to a center member 302 provided between the pair of support members 118. The center member 302 may extend along the axial direction 105 between the guide plate 112 and the end plate 110. As illustrated in the accompanying figure, the center member 302 is a single component. In another embodiment, the center member 302 may be a multi piece component provided between the pair of support members 118. In such a situation, a number of center members 302 may be provided between the pair of support members 118 spaced apart along the axial direction 105 between the guide plate 112 and the end plate 110.

As illustrated in FIGS. 3 and 4, the center member 302 includes two peripheral portions 403 and an intermediate portion 405 provided between the peripheral portions 403. The peripheral portions 403 are coupled with the pair of support members 118. A width of the intermediate portion 405 may be lower than width of each of the peripheral portions 403. Further, fillets may be provided at interfaces between the intermediate portion 405 and the peripheral portions 403. The various details of the center member 302, as described above, are purely exemplary in nature, and the center member 302 may be of any alternate shape within the scope of the present disclosure. For example, the center member 302 may have a rectangular cross section with a constant width.

FIG. 4 illustrates a sectional top view of the drill rig 100 along an axis A-A (shown in FIG. 2), according to an embodiment of the present disclosure. Each of the pair of support members 118 includes a slot 404 provided axially on an outer surface of the support member 118. The slot 404 is configured to at least partially and slidably receive the peripheral portions 403 of the center member 302. The larger width of the peripheral portions 403 may increase an area of contact between the slots 404 and the peripheral portions 403, thereby ensuring a secured coupling between the center member 302 and the pair of support members 118. Further, the center member 302 is fixedly coupled to each of the pair of support members 118 using one or more mechanical fasteners 410. The mechanical fasteners 410 are provided along the lateral direction 103 between the center member 302 and each of the pair of support members 118. The mechanical fasteners 410 include any one or a combination of, but not limited to, bolts, screws, rivets, and so on. The center member 302 may be made of any metal or alloy by any known manufacturing process such as casting, forging and so on. The center member 302 is configured to provide reinforcement and, thus, structural rigidity to the pair of support members 118 against bending, twisting, warping and other structural deformations. A combination of the center member 302 with the pair of support members 118 provides alignment of the carriage unit 108 and a drilling unit 128 (explained later) under axial and torsional loads during operation.

Referring to FIG. 1, the carriage unit 108 includes a pair of slide rails 126 spaced along a longitudinal direction 127 relative to each of the pair of support members 118. Further, each of the pair of slide rails 126 is provided on the carriage unit 108 spaced along the lateral direction 103 relative to each other. The pair of slide rails 126 extends between the guide plate 112 and the end plate 110 and is fixedly coupled thereon. Each of the pair of slide rails 126 has a circular cross section. In another embodiment, each of the pair of slide rails 126 may have any other configuration, such as a polygonal cross section, an elliptical, and so on. The pair of slide rails 126 is configured to slidably mount the drilling unit 128 thereon which will be explained later in detail.

Referring to FIG. 4, the carriage unit 108 also includes a feed cylinder rod 406. The feed cylinder rod 406 is provided within a feed cylinder 408 provided in the frame 102 of the drill rig 100. The feed cylinder rod 406 is positioned axially within the frame 102 and extends between the end plate 110 and the guide plate 112. The feed cylinder rod 406 may be hydraulically, pneumatically or mechanically operated. Accordingly, in one embodiment, the feed cylinder 408 may be fluidly coupled to the main, first and/or second manifold 204, 206, 208 to receive fluid for powering the feed cylinder rod 406. Alternatively, in another embodiment, the feed cylinder rod 406 may be powered by an independent source of power. The feed cylinder rod 406 may be configured to raise or lower the carriage unit 108 relative to the frame 102 based on an extension or retraction of the feed cylinder rod 406 within the feed cylinder 408. In an embodiment, the feed cylinder rod 406 may be actuated independently of the pair of cylinder rods 104.

During operation, when the head plate 106 is in a raised position based on the extension of the pair of cylinder rods 104, the feed cylinder rod 406 may extend and position the carriage unit 108 in a raised position such that the guide plate 112 may rest substantially closer to and below the head plate 106. Further, when the head plate 106 is still in a raised position, the feed cylinder rod 406 may retract and position the carriage unit 108 in a lowered position such that the guide plate 112 may now rest substantially away from the head plate 106. Additionally, when the carriage unit 108 is in a lowered position, the pair of cylinder rods 104 may retract such that the head plate 106 may be positioned in a lowered position. In a lowered position, the head plate 106 may rest substantially closer to and above the guide plate 112.

Referring to FIG. 1, the drill rig 100 includes the drilling unit 128 configured for drilling with the drill rod 107 and/or bolting the rock bolt in the roof and/or the rib of the mine. The drilling unit 128 may be any conventional drilling unit known in the art. For example, the drilling unit 128 may include a two speed drive unit. The drilling unit 128 may include a drill chuck (not shown) and a bolt socket (not shown). The drill chuck may be configured to removably hold the drill rod 107 therein. The bolt socket may be configured to removably hold the rock bolt, the anchor bolt and/or any other type of bolt therein. The drill chuck and the bolt socket may be coaxially mounted. The drill chuck and the bolt socket may be permanently coupled to and simultaneously driven by a motor (not shown). In an embodiment, the motor may be a hydraulic motor. The drill chuck may be directly driven by the motor. The bolt socket may be driven by the motor through a reduction planetary gear box (not shown) configured to provide speed reduction and torque multiplication. In another embodiment, the drilling unit 128 may include also include a single speed drive unit. In such a situation, the drilling unit 128 may actuated by modulating an output of the motor based on whether a drilling or bolting operation is being performed.

The drilling unit 128 may include a cooling arrangement (not shown). The cooling arrangement may include one or more valves, ports, passages and so on for flow and/or control of a coolant in the drilling unit 128. In an embodiment, the drill rod 107 may include an axial bore (not shown). The cooling arrangement may be configured to provide the coolant through the axial bore up to a tip of the drill rod 107 to cool the tip and/or chips removed during the drilling operation. The coolant may also provide flushing of the chips from the drilled bore.

Further, the drill rig 100 includes a translating cylinder 130 mounted on the end plate 110. Referring to FIG. 4, the translating cylinder 130 includes a cylinder barrel 132, an inner rod 134, and a cylinder rod 802 (shown in FIG. 8). More specifically, the inner rod 134 and the cylinder rod 802 are provided within the cylinder barrel 132 in an opposed configuration along the axial direction 105. The inner rod 134 is fixedly coupled to the guide plate 112. The cylinder rod 802 is fixedly coupled to the end plate 110. The cylinder barrel 132 is configured to slide and translate over the inner rod 134 and the cylinder rod 802. The translating cylinder 130 may be a hydraulically, pneumatically or electromechanically operated cylinder. Accordingly, the cylinder barrel 132, the inner rod 134 and/or the cylinder rod 802 may include one or more seals, glands, passages, reservoirs and so on for sealing, flow and/or control of fluid required for actuation of the translating cylinder 130.

Figure 8:
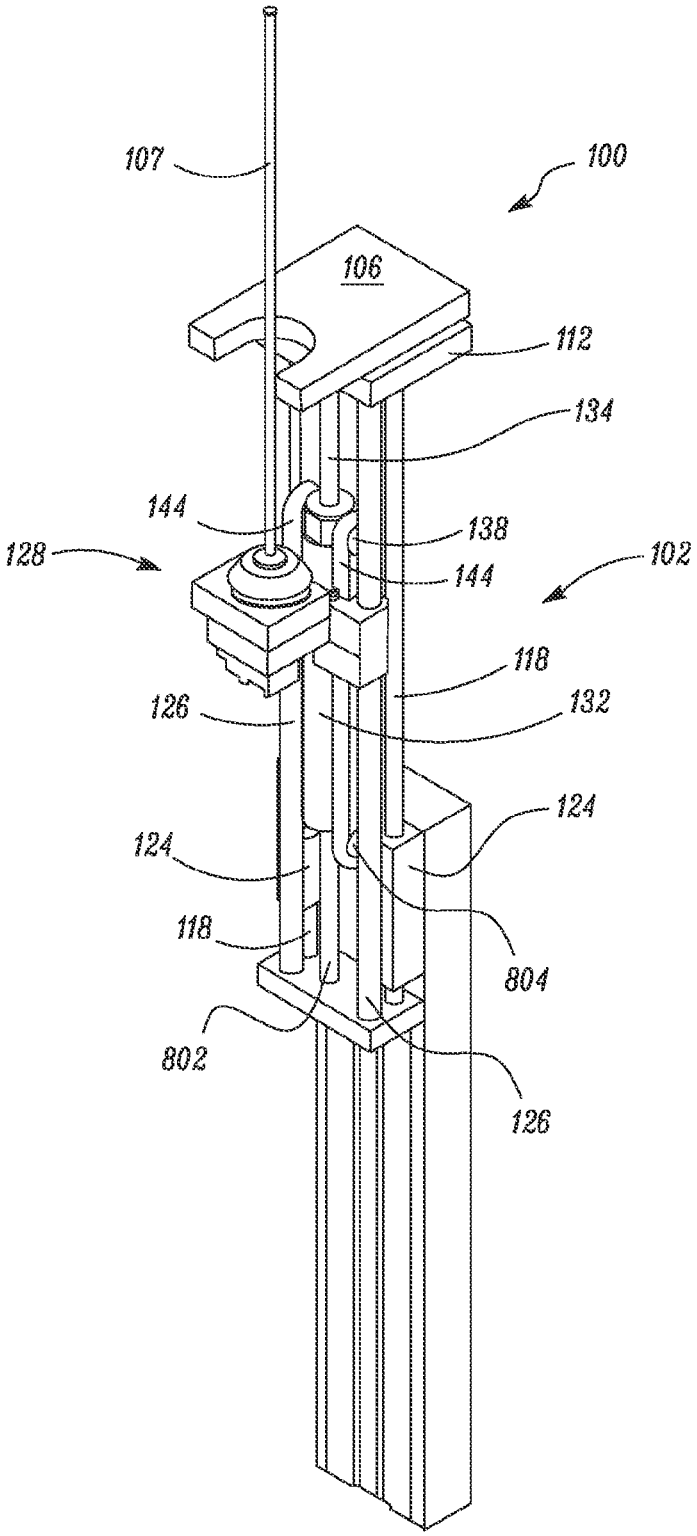
FIG. 8 is a perspective view of the drill rig showing a drilling unit in a raised position, according to an embodiment of the present disclosure.

Referring to FIG. 4, the drill rig 100 further includes a chain and pulley arrangement 136 extending between the end plate 110, and at least partly along a length of the translating cylinder 130. More specifically, the chain and pulley arrangement 136 includes a first set of pulleys 138 coupled to a first end 140 of the translating cylinder 130 and a second set of pulleys 804 (shown in FIG. 8) coupled to a second end 142 of the translating cylinder 130. The chain and pulley arrangement 136 includes a set of chains 144 extending over the first and second set of pulleys 138, 804. Further, the set of chains 144 is attached to at least one point to the center member 302 and to the drilling unit 128 at another point. Based on the extension and retraction of the translating cylinder 130, the set of chains 144 rotates over the first and second set of pulleys 138, 804 in a manner such that the drilling unit 128 is slidably raised and lowered along the pair of slide rails 126 with respect to the end plate 110. During operation, as shown in FIG. 1, in a lowered position of the cylinder barrel 132, the cylinder barrel 132 may enclose the cylinder rod 802 and the inner rod 134 may be exposed. Accordingly, the drilling unit 128 is in a lowered position and rests adjacent to the end plate 110. As shown in FIG. 8, in a raised position of the cylinder barrel 132, the cylinder barrel 132 may enclose the inner rod 134, and the cylinder rod 802 may be exposed. Accordingly, the drilling unit 128 is in a raised position and rests adjacent to the guide plate 112 away from the end plate 110.

The drill rig 100 may be provided with an operator interface (not shown). The operator interface may be configured to provide physical controls to operate the drill rig 100. In one embodiment, the drill rig 100 may have a fully manual mode of operation. In such a situation, the operator may be required to manually control each function of the drill rig 100. Accordingly, the operator interface may be provided with mechanical levers, knobs and so on for controlling various functions of the drill rig 100. In another embodiment, the drill rig 100 may have a fully automatic and/or a semi automatic mode of operation. It should be noted that in such an embodiment, the mode of operation may be interchangeable between the fully automatic, the semi automatic and/or the manual mode of operation. In such a situation, the operator may be required to manually control selected functions of the drill rig 100 in the semi automatic mode. In the automatic mode, the drill rig 100 may be configured to automatically perform the functions of the drill rig 100. Accordingly, the operator interface may be provided with electromechanical levers, switches, joysticks, knobs, or the like for switching between the semi automatic and the automatic mode of operation and/or controlling the selected functions of the drill rig 100 in the semi automatic mode. In another embodiment, the drill rig 100 may be remotely operated in any of the fully automatic, the semi automatic and/or the manual mode of operation from a location away from the drill rig 100.

INDUSTRIAL APPLICABILITY

The present disclosure relates to the drill rig 100. The drill rig 100 may be used for drilling and/or installing the bolts on the roof, the rib and/or the floor of the mine. The drill rig 100 may be the standalone equipment or may be installed on the machine including, but not limited to, the roof bolting machine, the longwall mining machine, the tunneling machine and the continuous mining machine. The drill rig 100, in addition to mining, may have applications in a number of industries, such as construction.

The drill rig 100 includes the center member 302. The center member 302 extends between each of the pair of support members 118 and is fixedly affixed therebetween. Such an arrangement of the center member 302 provides structural rigidity to the pair of support members 118 against undesirable bending, twisting, warping, misalignment and so on during operation of the drill rig 100.

The drill rig 100 includes the main manifold 204, the first manifold 206, the second manifold 208 and the pair of cylinders 202 as separate components as compared to an embodiment that may have the frame 102 as a single component with one or more manifolds with bores provided for receiving the pair of cylinder rods 104. This provides for a modular construction of the frame 102, the manifolds and the pair of cylinders 202. The modular construction may provide for improved serviceability of the drill rig 100. Further, in case of wear and tear of the main manifold 204, the first manifold 206, the second manifold 208 and/or the pair of cylinders 202, the modular construction may provide for replacement of only those components of the drill rig 100 that may have undergone wear and tear compared to replacement of the complete frame 102 in case of the integral construction. Further, the modular construction may provide a substantial reduction in an overall cost of construction and maintenance of the drill rig 100.

The modular construction also provides for formation of internal passages for the flow of the fluid for powering various components of the drill rig 100. This provides for reduction in number of hoses that may be required for supply of fluid for motive power. Additionally, the internal bore provided in the pair of cylinder rods 104 provides to eliminate a need of an additional hose for powering the grasping members.

The drill rig 100 includes the bush 116 provided on each of or any one of the pair of cylinder rods 104. The bush 116 may prevent contact between the guide plate 112 and the head plate 106 during operation of the drill rig 100. This may prevent placing of unintended objects between the guide plate 112 and the head plate 106, when the guide plate 112 and the head plate 106 may come close to each other.

Figure 5:
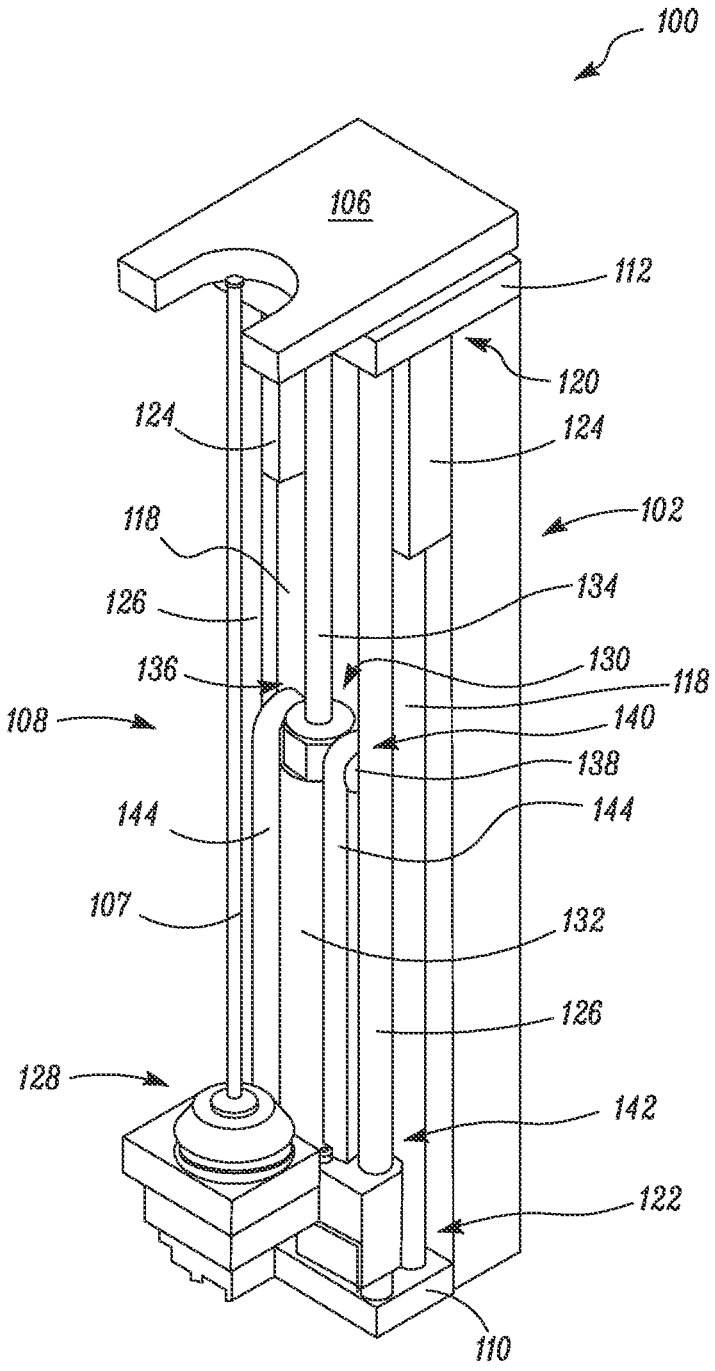
FIG. 5 is a perspective view of the drill rig in a native configuration, according to an embodiment of the present disclosure.
Figure 6:
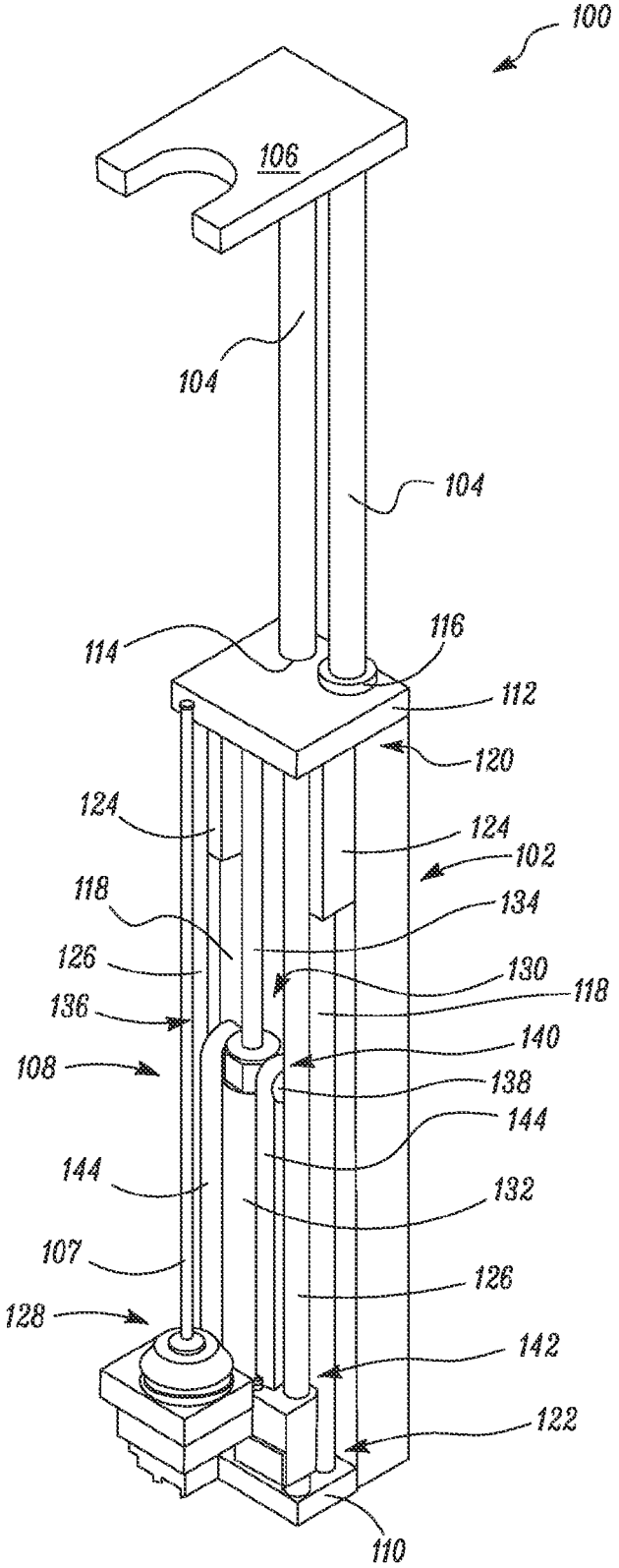
FIG. 6 is a perspective view of the drill rig showing a head plate in a raised position, according to an embodiment of the present disclosure.
Figure 9:
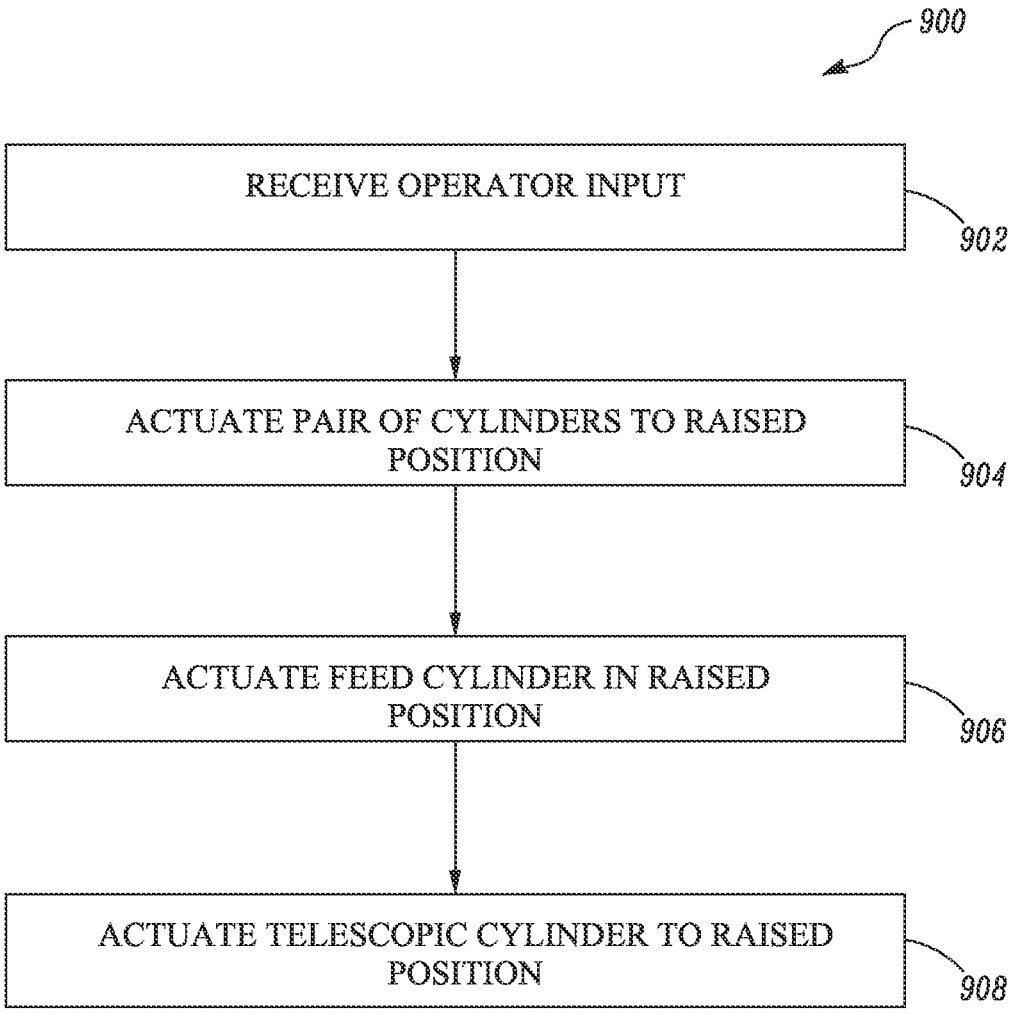
FIG. 9 is a flowchart of a control strategy for the drill rig, according to an embodiment of the present disclosure.

Referring to FIG. 9, a flowchart of a control strategy 900 for the drill rig 100 is illustrated. The control strategy 900 will now be described in relation with FIGS. 5 to 8. Initially, as shown in FIG. 5, the drill rig 100 is in a native configuration. Accordingly, the head plate 106, the guide plate 112, the carriage unit 108 and the drilling unit 128 may be in respective lowered positions. At step 902, an operator input is received via the operator interface for operating the drill rig 100. At step 904, the pair of cylinder rods 104 may be actuated to a raised position. Based on the actuation of the pair of cylinder rods 104, as shown in FIG. 6, the head plate 106 may be positioned in a raised position.

Figure 7:
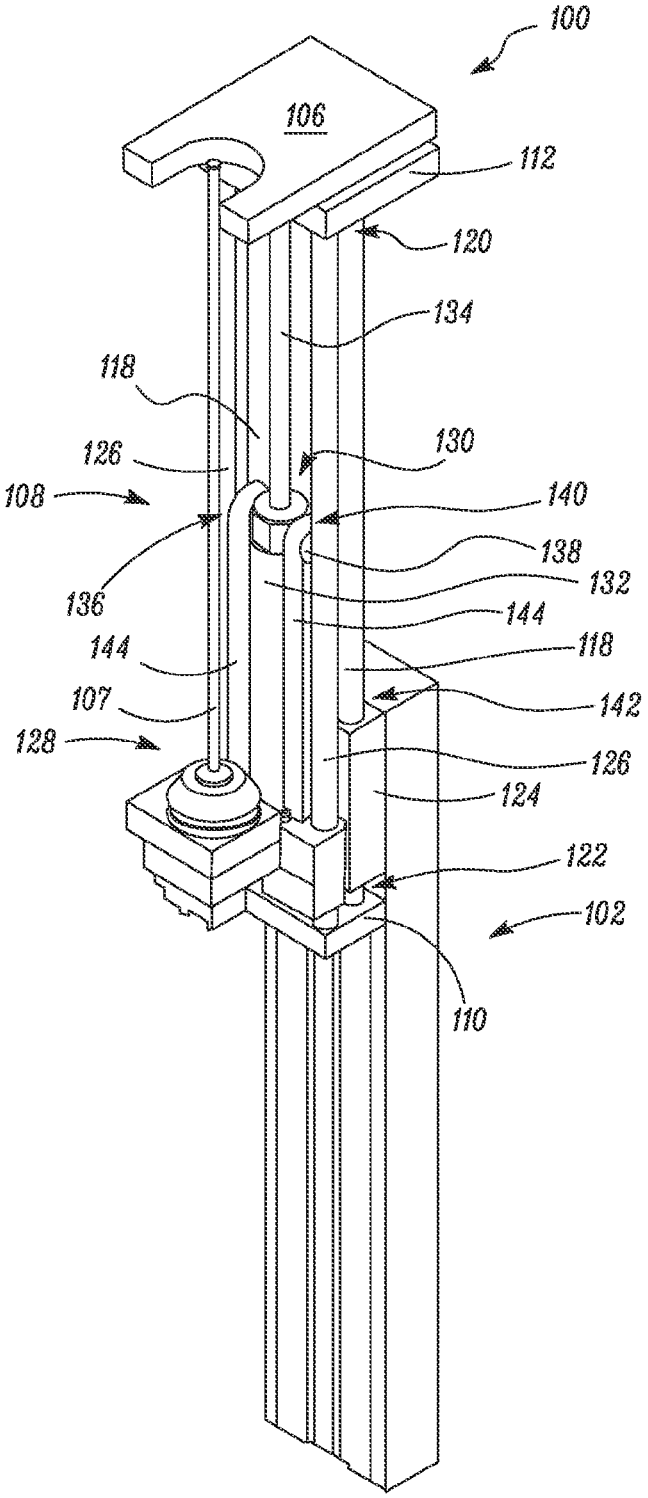
FIG. 7 is a perspective view of the drill rig showing a carriage unit in a raised position, according to an embodiment of the present disclosure.

At step 906, the feed cylinder rod 406 is actuated to a raised position. Based on the actuation of the feed cylinder rod 406, as shown in FIG. 7, the carriage unit 108 (including the drilling unit 128) is positioned from a lowered position to a raised position. At step 908, the translating cylinder 130 is actuated to a raised position. Based on the actuation of the feed cylinder rod 406, as shown in FIG. 8, the drilling unit 128 is positioned from a lowered position to a raised position.

It should be noted that the control strategy 900 disclosed herein is merely exemplary and may vary as per system design and requirements. For example, based on a required operation, various elements of the drill rig 100 may be positioned in a raised position, a lowered position and/or an intermediate position relative to each other. Further, in an embodiment, the control strategy 900 may be configured for a complete automated operation of the drill rig 100. In such a situation, the drill rig 100 may perform the required operations automatically based on one or more operator inputs. For example, the operator inputs may include inputs indicative of starting or stopping the drill rig 100. In another embodiment, the control strategy 900 may be configured for a semi automated operation of the drill rig 100. In such a situation, the drill rig 100 may automatically perform at least a part of the required operations based on one or more operator inputs and at least a part of the required operations may be controlled by the operator. For example, the raising and lowering of the elements of the drill rig 100 may be performed automatically but the speed of operation may be controlled manually by the operator.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A drill rig comprising:

a frame;

a pair of cylinder rods provided laterally spaced relative to each other, the pair of cylinder rods configured to extend and retract relative to the frame along an axial direction;

a carriage unit mounted to the frame, the carriage unit comprising:

a first slide block comprising a first axial channel;

a second slide block comprising a second axial channel, wherein the first slide block and the second slide block are provided laterally spaced relative to each other;

a first support member provided slidably within the first axial channel;

a second support member provided slidably within the second axial channel;

a guide plate coupled to a first end of each of the first support member and the second support member;

an end plate coupled to a second end of each of the first support member and the second support member;

a center member coupled to and provided between the first support member and the second support member, wherein the center member extends along the axial direction between the guide plate and the end plate, the center member being configured to reinforce the first support member and the second support member; and a slide rail provided longitudinally spaced relative to each of the first support member and the second support member; and a drilling unit slidably mounted on the slide rail.

2. The drill rig of claim 1, wherein each of the first support member and the second support member further includes a slot configured to receive the center member.

3. The drill rig of claim 1, wherein the center member is coupled to each of the first support member and the second support member via a mechanical fastener.

4. The drill rig of claim 1, wherein each of the first support member and the second support member has a substantially D-shaped cross section.

5. The drill rig of claim 1, wherein the guide plate further includes a pair of bores, each of the pair of bores configured to slidably receive one of the pair of cylinder rods.

6. The drill rig of claim 1 further comprising:

a head plate coupled to a top surface of the pair of cylinder rods, the head plate configured to move along the axial direction based on the extension and retraction of the pair of cylinder rods.

7. The drill rig of claim 1, wherein the frame further includes:

a first manifold;

a second manifold provided axially spaced apart relative to the first manifold; and a main manifold provided in fluid communication with the first and second manifolds, the main manifold configured to provide fluid to the first and second manifolds.

8. The drill rig of claim 7 further comprising:

a pair of cylinders extending between the first and second manifolds, each of the pair of cylinders being configured to slidably receive one of the pair of cylinder rods.

9. The drill rig of claim 1, wherein the carriage unit further includes a feed cylinder configured to raise and lower the carriage unit relative to the frame.

10. The drill rig of claim 1 further comprising:

a translating cylinder;

a chain and pulley unit coupled to the translating cylinder; and the drilling unit coupled to the chain and pulley unit, wherein the translating cylinder is configured to slidably move the drilling unit along the slide rail.

11. A carriage unit for a drill rig, the carriage unit comprising:

a first slide block comprising a first axial channel;

a second slide block comprising a second axial channel, wherein the first slide block and the second slide block are provided laterally spaced relative to each other;

a first support member provided slidably within the first axial channel;

a second support member provided slidably within the second axial channel;

a guide plate coupled to a first end of each of the first support member and the second support member;

an end plate coupled to a second end of each of the first support member and the second support member; and a center member coupled to and provided between the first support member and the second support member, wherein the center member extends along an axial direction between the guide plate and the end plate, the center member being configured to reinforce the first support member and the second support member.

12. The carriage unit of claim 11, wherein each of the first support member and the second support member further includes a slot configured to receive the center member.

13. The carriage unit of claim 11, wherein the central member is coupled to each of the first support member and the second support member via a mechanical fastener.

14. The carriage unit of claim 11, wherein each of the first support member and the second support member has a substantially D-shaped cross section.

15. The carriage unit of claim 11, further comprising:

a slide rail provided longitudinally spaced relative to each of the first support member and the second support member.

16. A drill rig having the carriage unit according to claim 15, comprising:

a frame;

a pair of cylinder rods provided laterally spaced relative to each other, the pair of cylinder rods configured to extend and retract relative to the frame along an axial direction; and a drilling unit slidably mounted on the slide rail.

17. The drill rig of claim 16 further comprising:

a head plate coupled to a top surface of the pair of cylinder rods, the head plate configured to move along the axial direction based on the extension and retraction of the pair of cylinder rods.

* * * * *